US005730614A

United States Patent [19]

Yu

[11] Patent Number: 5,730,614

[45] Date of Patent: Mar. 24, 1998

[54] ELECTRICAL CONNECTOR WITH IMPROVED SPRING METAL LATCH MECHANISM

[75] Inventor: Wang-I Yu, Taipei, Taiwan

[73] Assignee: Berg Technology, Inc., Reno, Nev.

[21] Appl. No.: 592,416

[22] PCT Filed: Aug. 17, 1994

[86] PCT No.: PCT/US94/09267

§ 371 Date: Feb. 6, 1996

§ 102(e) Date: Feb. 6, 1996

[87] PCT Pub. No.: WO95/05693

PCT Pub. Date: Feb. 23, 1995

[30] Foreign Application Priority Data

Aug. 19, 1993 [JP] Japan ..... 5-45222

[51] Int. Cl.[6] ..... H01R 13/62

[52] U.S. Cl. ..... 439/326

[58] Field of Search ..... 439/325, 326, 439/328, 341

[56] References Cited

U.S. PATENT DOCUMENTS 5,112,242 5/1992 Choy et al. ..... 439/326

5,161,995 11/1992 Bakke et al. ..... 439/326

5,169,333 12/1992 Lee ..... 439/326

5,226,833 7/1993 Lwee ..... 439/326

5,383,792 1/1995 Korsunsky et al. ..... 439/326

*Primary Examiner*—Neil Abrams

*Assistant Examiner*—Barry M. L. Standig

*Attorney, Agent, or Firm*—Woodcock Washburn Kurtz Mackiewicz & Norris LLP

[57] ABSTRACT

An electrical connector is provided in which latches are firmly secured to a housing. A fitting base, over which a lower end of the latch is fitted, and support base for supporting a U-shaped section extending from the lower end of the latch are provided at the end of the step surface section of the housing. The lower end sections of the latch have such a shape as to surround the fitting base on four sides and fittingly contact with the fitting base on the four sides. In the fitted state of the latch, part of the lower end of the latch is held in the recess defined by the fitting base, support base and housing's step surface section. The latch is firmly fitted over the fitting base such that a hole of the latch is fitted over a projection.

3 Claims, 4 Drawing Sheets

ELECTRICAL CONNECTOR WITH IMPROVED SPRING METAL LATCH MECHANISM

FIELD OF THE INVENTION

The present invention relates to electrical connectors and, in particular, to a connector for establishing board-to-board interconnection.

BACKGROUND OF THE INVENTION

Various electrical connectors have been known which are adapted to connect a mother board (first circuit board) to a daughter board (second circuit board), such as a single in-line memory module, or SIMM connector.

For example, JPN. UM. Appln. KOKAI Publication 2-95183 (JPN. UM. Application 1-4128 specification) discloses an electrical connector having a resin housing attachable to a mother board and a pair of metal latches for latching a daughter board.

The housing has an opening in its upper surface receiving the daughter board and contact terminals provided in the opening so as to set the daughter board in electrical contact with the other board.

The metal latch comprises a fitting section fitted between both ends of the housing, an elastic section extending upwardly from the fitting section and a latching section extending from the elastic section and latching the daughter board in place. Here the fitting section of the latch is inverse U-shaped in cross section. The inverse U-shaped fitting section is set in contact with the top surface and both the side surfaces of the housing, a total of three surfaces, and fitted there whereby the latch is fixed to the housing.

The daughter board, being obliquely inserted into the opening in the housing, is swung with the daughter board set between a pair of latches. In that operation process, the pair of latches are pushed away from each other by the side edges of the daughter board and hence the latches are elastically flexed in such a direction as to push the paired latches away from each other. Then when the daughter board achieves a predetermined attitude, the paired latches are elastically returned back to their original state, so that the daughter board is latched to the housing. By so doing, the daughter board is held at a predetermined attitude.

However, the following considerations arise with respect to this type of connector.

(i) The latch has its inverse U-shaped fitting section fitted in the housing in a three-surface fitting relation. The three-surface fitting structure is inadequate in its strength and, if the daughter board is repeatedly attached and detached, the fitting section of the latch is deformed due to stress caused thereby and the fixing of the latch to the housing is incomplete.

(ii) When the daughter board is inserted into the housing, if any excessive reaction force from the daughter board acts upon the latch or any unwanted stress acts upon the latch due to, for example, an operation error, the latch is deformed beyond its elastic deformation limit and hence there is a risk that the characteristics of the latch will be impaired. However, the aforementioned conventional electrical connector has not any restriction mechanism for restricting the latch from being deformed beyond its elastic deformation limit.

(iii) Since the elastic section extending from the fitting section of the latch, that is, the effective spring length of the latch, is relatively short, a strong force is required in operating the latch. For example, assume that the length of the spring section extending from the fitting section of the latch is simply made longer in order to obtain a greater effective spring length. Then the fixing of the latch to the housing becomes unstable in addition to the drawback that the latch becomes undesirably longer and more costly to manufacture.

Thus, there is a need for an improved connector for establishing board-to-board interconnection with a latching mechanism that provides for reliable attachment of the boards in a firmly fixed state and which can withstand the stresses associated with repeated attaching and detaching of the boards. The present invention provides an electrical connector that satisfies this need.

SUMMARY OF THE INVENTION

According to the present invention an electrical connector is provided which connects a first circuit board to a second circuit board through a plurality of contact terminals.

In accordance with an electrical connector of the present invention, the latch is fitted in the housing in a four-surface fitting relation to the housing and latch-to-housing contact is made in a five-surface contacting relation. In comparison with the conventional system according to which latch-to-housing contact and fitting are achieved in three-surface fitting relation, it is possible to maintain the latches in a firmly fixed state even if the attaching and detaching of the circuit board to and from the connector are repeated many times.

Also, since restricting members for restricting any undesirable displacement of the latch are provided all around the latch, it is possible to restrict any excessive deformation of the latch even if any unwanted force acts upon the latch due to an operation error, etc., and hence to maintain the characteristic of the latch. It is also possible to operate the latch with a small force because an effective spring length is provided for.

One object of the present invention is to provide an electrical connector which can maintain a pair of latches in a firmly fixed state even when an associated circuit board is repeatedly attached and detached.

Another object of the present invention is to provide an electrical connector which, when a pair of latches encounter any unwanted stress, can suppress its deformation and maintain the characteristics of the latch.

Another object of the present invention is to provide an electrical connector which, in spite of making the effective spring length of the latch great, requires no large latches and, in addition, stably fixes the latches to the housing.

In the present specification the term "parallel" represents not only "parallel" in a geometrically strict sense but also "parallel" in a general sense of the word and the same thing can also be said of "vertical" or "perpendicular".

DETAILED DESCRIPTION OF THE PREFERRED EMBODIMENTS

Figure 1:
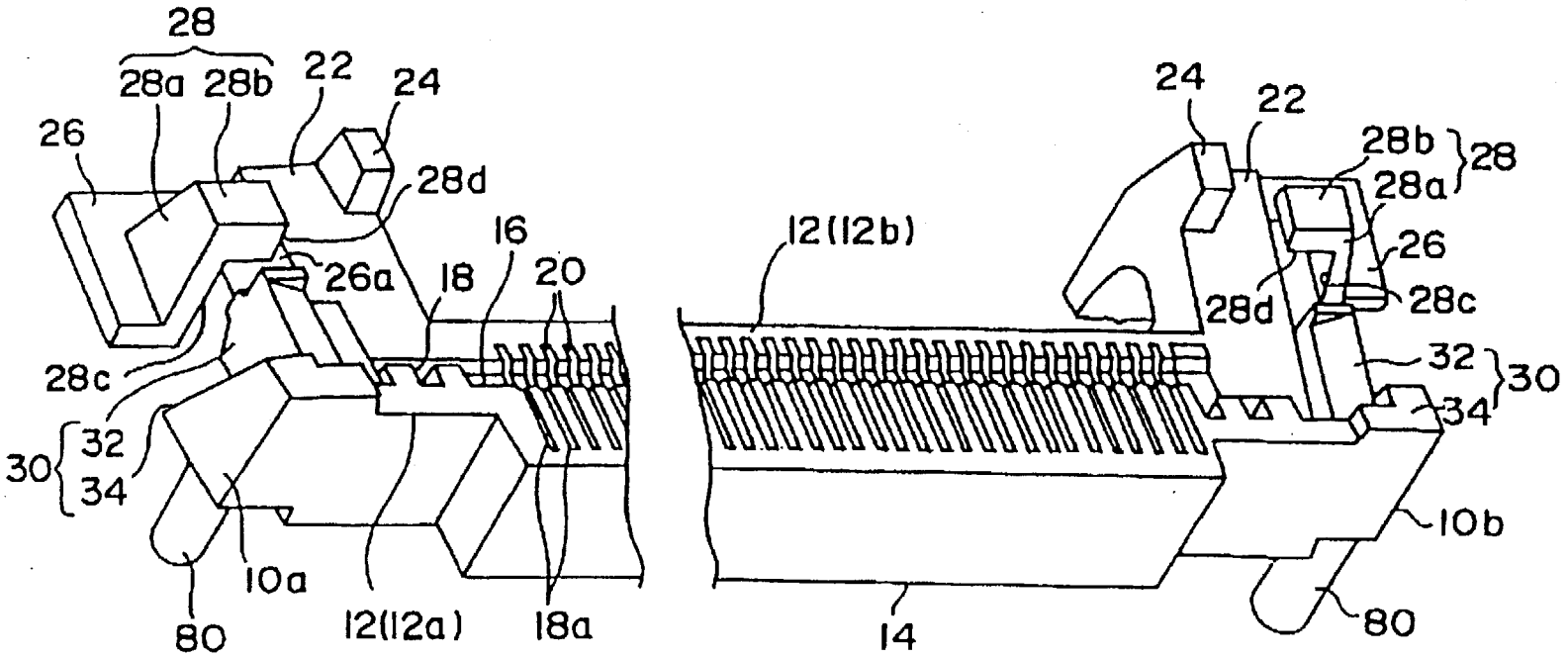
FIG. 1 is a perspective view showing a housing of an electrical connector of the present invention.
Figure 2:
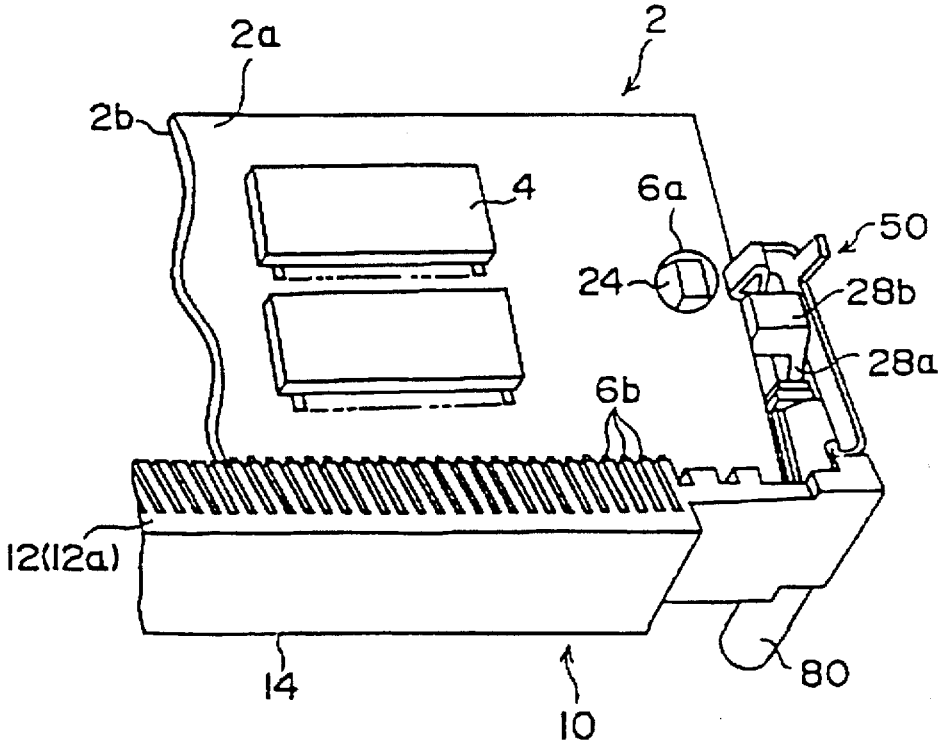
FIG. 2 is a perspective view showing a state of the major section of the electrical connector of FIG. 1 with a circuit board mounted thereon.

An electrical connector of the present invention as shown in FIGS. 1 and 2 mechanically and electrically connects a mother board (not shown) to a daughter board 2. The daughter board 2 is comprised of, for example, a single in-line memory module (SIMM) with a memory element 4 attached thereto. SIMM 2 has an engaging hole 6*a* at each end portion thereof. As is known in the art, a plurality of solder pads 6*b* are arranged at one side of SIMM 2, i.e., that side which is to be inserted into the connector in the manner described below. It is to be noted that reference numerals 2*a* and 2*b* show a front surface and a rear surface of SIMM 2, respectively.

The connector includes an elongated housing 10 injection-molded from an insulating resin material and the housing 10 has parallel end faces 10*a* and 10*b* and top and bottom surfaces 12 and 14, respectively. The top surface 12 is stepped to provide an upper surface section 12*a* and lower surface section 12*b*, noting that, here, the higher surface section 12*a* is parallel to the bottom surface 14 and perpendicular to the end faces 10*a* and 10*b* and the lower surface section 12*b* is so inclined as to correspond to the attitude assumed by SIMM, as will be set out below, when SIMM is operated. A step surface section 16 is provided between the upper surface section 12*a* and the lower surface section 12*b* of the housing such that it is formed perpendicular to the top and bottom surfaces 12 and 14. An opening 18 is provided along the length of the housing to hold the one side of SIMM 2 there. The opening 18 leads to the lower surface section 12*b* of the housing 10 from the step surface section 16 side, but only the lower surface section 12*b* is shown.

The opening 18 is so designed as to enable SIMM 2, which has assumed the operation attitude shown in FIG. 2, to be inclined relative to the mother board with the connector attached thereto. Here the "operation attitude" of SIMM 2 is intended to mean the state in which SIMM 2, having been inserted into the opening 18 from the top surface 12 side of the housing, assumes a predetermined attitude (an inclined attitude in the present embodiment) relative to the mother board and makes a complete electrical connection to the mother board through a plurality of conductive contact terminals 20 as set forth below.

The plurality of conductive contact terminals 20 are arranged in the opening 18 along the length of the housing. The contact terminals 20 are forced into corresponding recesses 18*a* in the housing 10 in an orthogonal relation to the opening 18 and firmly set there. The contact terminals 20 can be any of the elastic contact terminals known in the art.

A first support wall 22 extends from each end of the lower surface section 12*b* in an obliquely upward direction corresponding to the operation attitude of SIMM so as to support the rear surface 2*b* of SIMM 2. A projection 24 is provided on the top surface of the first support wall 22 so as to engage a corresponding engaging hole 6*a* in the daughter board and to assure proper alignment of the SIMM 2 in the connector.

A second support wall 26 extends from each first support wall 22 such that it provides a step section on a lower side. A wall surface 26*a* is provided in a direction vertical to the width direction of the housing 10 such that it is located between the first and second support walls 22 and 26.

The second support wall 26 has an L-shaped member 28 set upwardly toward the first support wall 22. The L-shaped member 28 comprises a column member 28*a* extending from the second support wall 26 and a projection 28*b* extending from the column member 28*a* toward the inside, and in the width direction, of the housing 10. Further, the lower surface of the projection 28*b* provides a horizontal wall surface 28*d* in a width direction of the housing 10.

Further, latch-mount sections 30 are provided one at each end of the step surface section 16 of the housing so that a metal latch is mounted there. The latch-mount section 30 will be set out bellow in more detail.

The bottom surface 14 of the housing provides a surface on which the mother board is to be mounted. A circular-column leg 80 extends from each end portion of the housing and is mounted on the mother board by being inserted into a corresponding mount hole in the mother board, not shown, and set there.

Figure 3:
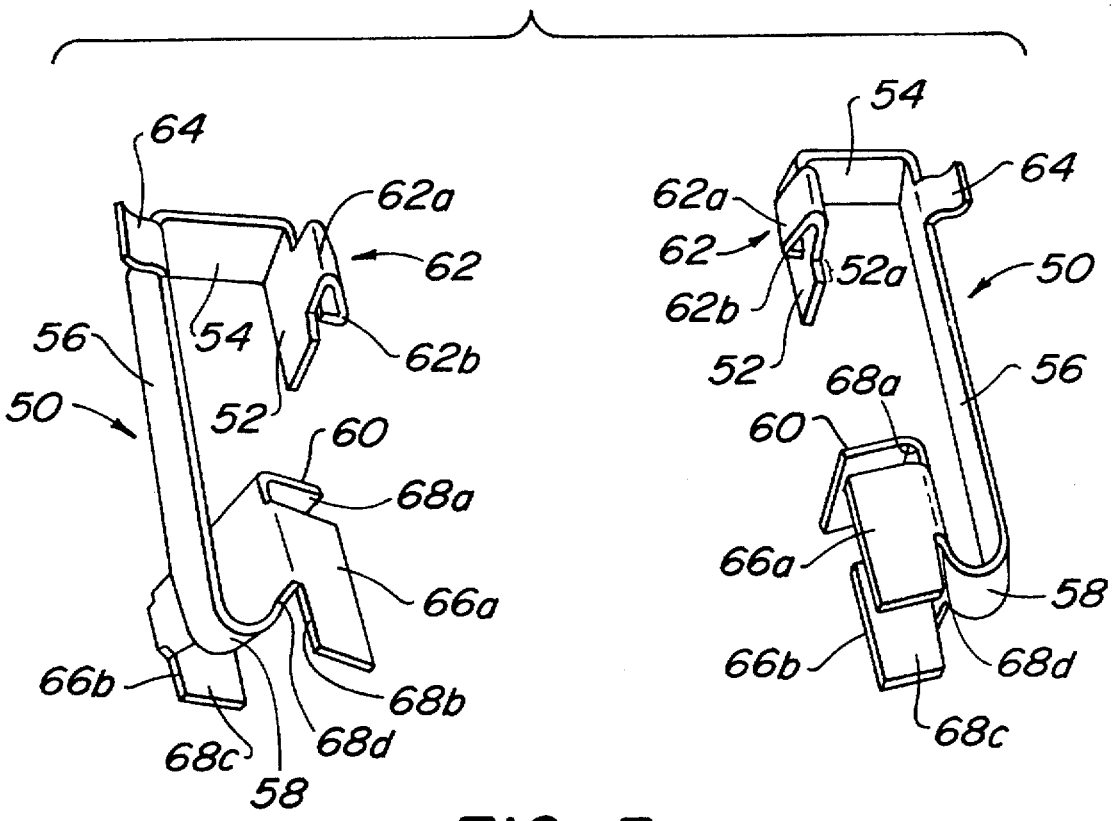
FIG. 3 is a perspective view showing a pair of metal latches to be mounted in the housing of FIG. 1.

The metal latch set out above will be explained below with reference to FIGS. 3 and 4. Here an X-Z plane shows a plane on which SIMM 2 extends at its operation attitude. Each latch 50 is formed of a metal sheet (phosphor bronze, for instance) having a predetermined elastic property. Between a first end section 52 and a second end section 60 the metal latch 50 has an intermediate section 54, long arm section 56 and U-shaped section 58. Stated in more detail, the first end section 52 is substantially perpendicularly bent in relation to and merges with the intermediate section 54. The long arm section 56 extends from the intermediate section 54 in an opposed relation to the first end section 52 and is bent at its forward end portion to provide a U-shaped section 58. The forward portion of the U-shaped section 58 is bent to provide the second end section 60 substantially parallel no the intermediate section 54.

A hook 62 extends at the outward end surface of the first end section 52 so as to elastically urge the side edge of SIMM 2. A lug 64 extends at the outer end face of the arm 56 so that the latch 50 may be manually operated. On both sides of the U-shaped section 58 in the neighborhood of the second end section 60, a pair of legs 66*a* , 66*b* extend in the same direction as that of the second end section 60. The legs 66*a* and 66*b* are formed in a mutually opposed relation and are contacted with a latch fitting base 32 as set forth below.

A first flat contact surface 68*a* is provided on the outer surface of the U-shaped section 58 at an area from which the legs 66*a* and 66*b* extend. Similarly, the inner surfaces of the leg 66*a* , leg 66*b* and second end section 60 of the latch 50 provide second, third and fourth flat contact surfaces 68*b*, 68*c* and 68*d*, respectively. These contact surfaces 68*a*–68*d* of the latch 50 provide a fitting area corresponding to the latch fitting base 32 as will be set out below.

A pair of such latches 50, 50 are symmetrically formed relative to each other. With the latches 50, 50 mounted on the housing 10, their hook-to-hook spacing is made somewhat narrower than the width of SIMM 2 so that SIMM 2 can be latched between both the side edges of the latches.

Figure 4A:
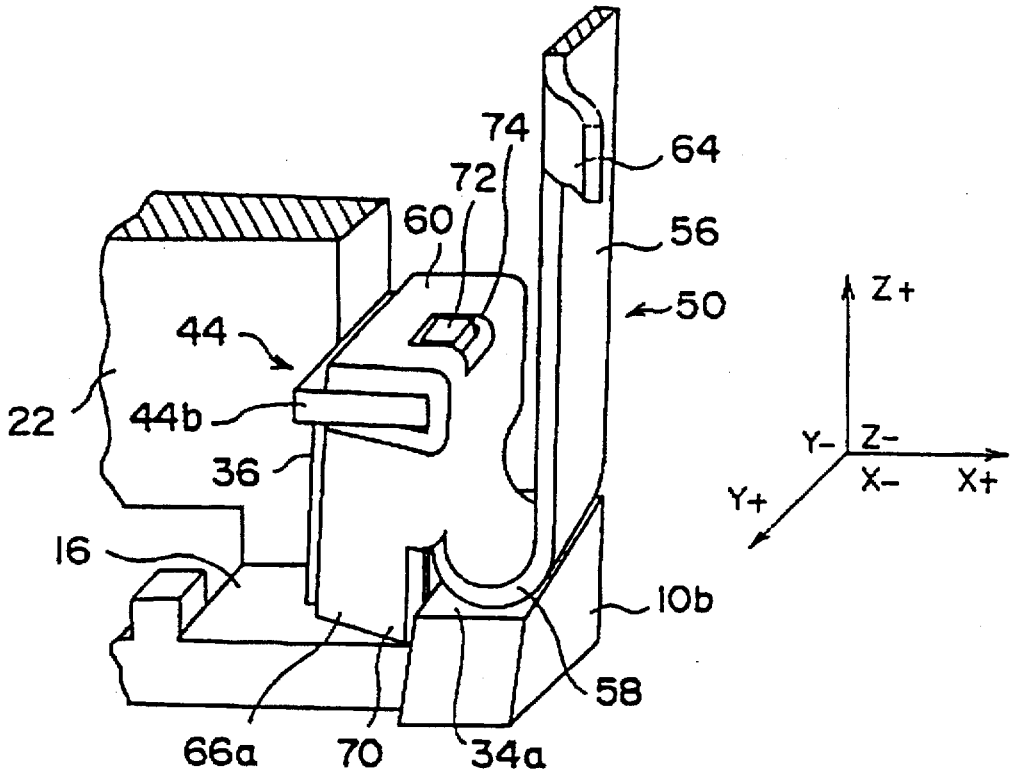
FIG. 4 includes (A) and (B), (A) being a perspective view in enlarged view showing a latch fitting base of the housing of FIG. 1 and (B) being a perspective view showing a state of a latch fitted in the latch fitting base of (A).
Figure 4B:
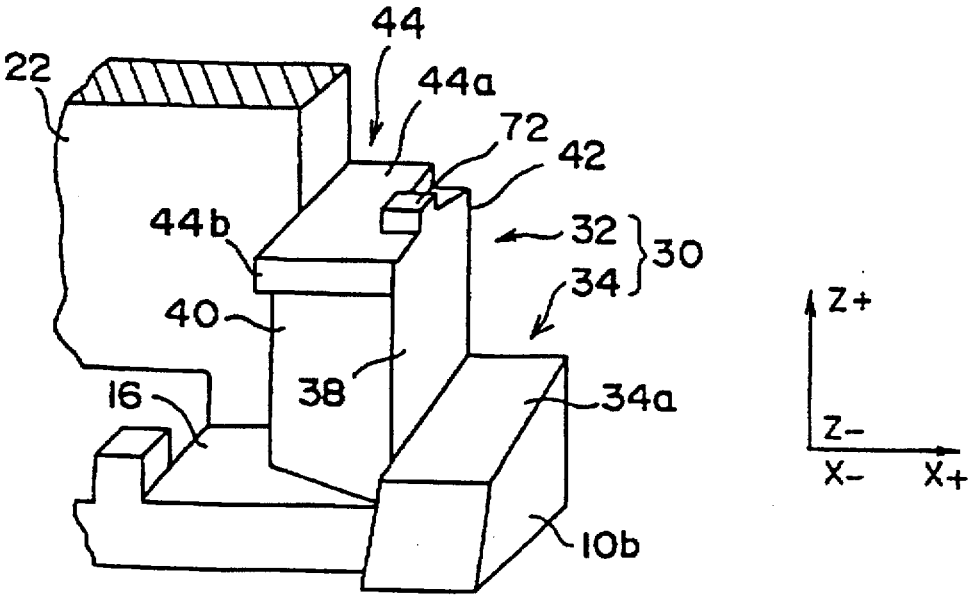

As shown in FIGS. 4(A) and 4(B) in particular, a latch mount section 30 of the housing 10 is equipped with the latch fitting base 32 and latch support base 34 integral with the housing 10. Either the latch fitting base 32 or the latch support base 34 is inclined at its attitude as in the case of the first and second support walls 22 and 26.

The latch support bases 34 extend on both the ends of the step surface section 16 as viewed in the width direction of the step surface section 16 and the upper surface of the latch support base 34 provides an inclined surface 34*a* corresponding to the operation attitude of SIMM 2. The outer surface of the closed end of the U-shaped section 58 of the latch 50 abuts against the inclined surface 34*a*.

The latch fitting base 32 is located adjacent the latch support base and has a substantially hexahedral configuration. The latch fitting base 32 provides, at its lower side, four wall surfaces 36, 38, 40 and 42 vertical to the step surface section 16 with a base seat 44 defined on its top surface. The latch fitting base 32 is provided integral with support wall 22 of the housing 10 through an inside wall surface 36 situated on the opening 18 side and integral with the step surface of the housing 10 through a lower surface.

Assume that the inside wall surface 36 is disregarded in view of its small exposed area. Then, of the six wall surfaces of the latch fitting base 32, four wall surfaces 38, 40, 42 and 44 are actually exposed except for the inside wall surface 36 and lower surface. The fitting area of the latch 50 is fitted over the exposed four wall surfaces of the latch fitting base. With the fitting area of the latch 50 fitted over the latch fitting base 32 the aforementioned four wall surfaces of the latch fitting base 32 are placed in contact with the corresponding contact surfaces of the fitting section of the latch 50 as will be set out below.

The outside wall surface 38 opposing the inside wall surface 36 of the latch fitting base 32 is parallel to the housing end face (10*a*, 10*b*). The first contact surface 68*a* (see FIG. 3) of the U-shaped section of the latch is set in contact with the outside wall surface 38 of the latch fitting base. The second and third contact surfaces 68*b* and 68*c* (see FIG. 3) of the legs 66*a* and 66*b* of the latch 50 are set in contact with the opposite side walls 40, 42 of the latch fitting base extending between the inside wall surface 36 and the outside wall surface 38.

In order to restrict an up/down movement of the legs 66*a*, 66*b* (in a direction Z vertical to the housing's step surface section 16), a pair of recesses (only one is shown) are formed between the side wall surfaces 40, 42 and the base seat 44 of the latch fitting base 32 to receive the legs of the latch. That is, in order to locate the side walls 40 and 42 more inside the vertical wall 44*b* of the side surfaces of the base seat 44, the side walls 40 and 42 of latch fitting base are so arranged as to gradually narrow their distance from the inside wall surface toward the outside wall surface. As a result, a pair of first recesses are provided between the side wall surface 40, 42 and the base seat 44.

In order to correspond to the arranging relation of these side walls 40 and 42, the leg(66*a*)-to-leg(66*b*) distance of the latch 50 are so set as to be gradually narrowed along the direction in which the legs extend. Further, the height of the side wall surfaces 40 and 42 provided between the housing's step surface section 16 and the base seat 44 is set substantially equal to the height of the legs 66*a* and 66*b*.

The legs 66*a* and 66*b* of the latch 50 received in the paired first recesses have their upper end sections and lower end sections set in contact with the base seat 44 and housing's step surface section 16, respectively, so that the legs are prevented from being moved in the up/down direction.

Further a pair of recesses (only one is shown) are provided in the housing's step surface section 16 so as to receive the lower rear corners 70 of the legs 66*a*, 66*b*. The second recesses are provided by the housing's top surface section 16 and latch support base 34 provided orthogonal to the step surface section 16. Since the corner areas 70 of the legs 66*a* and 66*b* are received in the second recesses, they are prevented from being moved in a backward (X+) direction.

The fourth contact surface 68*d* at the second end section 60 of the latch 50 is set in contact with a top surface 44*a* of the base seat 44*a*.

The latch 50 is prevented from being moved in the back/fourth and right/left directions through the contacting of the latch fitting base 32 with the first to fourth contact surfaces 68*a* to 68*a* of the latch 50 as set out above.

In order to more positively prevent a backward (X+) movement, it is preferred that a projection 72 be provided on the top surface 44*a* of the base seat 44 and that a hole 74 for engaging with a projection 72 be provided in the second end section 60 of the latch 50.

The attaching and detaching of SIMM 2 to and from the connector above will be explained below.

When SIMM 2 is to be attached to the connector, SIMM is inserted into the opening 18 of the housing 10 and, upon being swung relative to the first support walls 22, SIMM has its side ends first abutted against the inclined surfaces 62*a* of the hooks 62. Upon further movement of SIMM, the side ends of SIMM, being abutted against the inclined surfaces 62*a* of the hooks of the latches, push the first end sections 52 of the latches 50, 50 away from each other in the width (X+) direction and the latches 50 become temporarily elastically deformed. When the side ends of SIMM are moved past the lower ends 62*b* of the hooks, the latches 50, 50 are returned back to their original state under their own elasticity. The holes 6*a*, 6*a* of SIMM 2 are fitted over the corresponding projections 24 of the first support walls 22, 22 and SIMM 2 assumes an operation attitude with its rear surface 2*b* supported by the first support wall 22. At this time, the lower ends 62*b* of the hooks are moved clear of the side end of SIMM onto the surface 2*a* of SIMM so that SIMM 2 is held at an operation attitude.

When SIMM 2 is to be detached from the connector, the lugs 64 of the latches 50, 50 are pushed by an operator's fingers away from each other in the X+ direction and the lower ends 62*b*, 62*b* of the hooks are moved from the surface 2*a* of SIMM outwardly of the side end of SIMM. By so doing, SIMM 2 is disengaged from the latches 50 and can be taken out of the opening 18.

When the latches 50, 50 are pushed away from each other during the above-mentioned attaching and detaching operations, stress forces on the latches act in the X+ direction as the latches are moved away from each other. However, stress acting upon the latch 50 may not always be restricted to the X+ direction only and may also act in the X−, Y+ and Y−directions. As set forth in the examples below, in the present invention portions of the housing, such as the L-shaped member 28, restrict movement of the first end section 52 of the latches such that even if stress acts in any of these directions, excessive stress on the latch is restricted, thus preventing the latches from being displaced beyond their elastic deformation limit.

EXAMPLE 1

Assume that stress acts in the X+ direction:

Considering the first end section 52, the inner surface of a forward end portion 52*a*, at an area between the forwardmost end of the latch 50 and the hook 62, abuts against a vertical surface 28*c* of the column member 28*a* such that no further displacement of the latch occurs, thus preventing the latches 50 from being displaced beyond their elastic deformation limit.

EXAMPLE 2

Assume that stress acts in the X− direction:

The outer surface of the first end section 52 is abutted against wall surface 26*a* between the first support wall 22 and the second support wall 26 of the housing 10 whereby X−direction displacement is restricted.

EXAMPLE 3

Assume that stress acts in the Y+ direction:

To effect: a stress causing force in the Y+ direction, a force acts due to a contact load caused between the contact terminals 20 and SIMM 2 when it is in an operational attitude.

When such a force occurs, the upper side end face of the latch's forward end portion 52*a* is abutted against the lower surface (horizontal wall surface) 28*d* of the projection 28*b*, thus restricting a Y+ direction displacement.

EXAMPLE 4

Assume that stress acts in the Y−direction:

At least a portion of the lower side end face of the first end section 52 of the latch 50 and at least a portion of the lower side end face of the arm 56 are abutted against the second support wall 26, thus restricting any excessive Y−direction stress.

Of the forces set out above, the Y+ and Y− forces correspond to those forces bending the metal latch 50 in the width direction. Since known stock metal plates from which a latch of this type is generally made has high rigidity in that direction, if an excessive force in one of these directions occurs there is no expectation that the latch will be returned back to its original state under its own elastic force. Thus, without the stress restriction provided by the present invention the fixing of the latch 50 to the housing 10 can become loosened and it is, therefore, necessary to restrict any excessive stress in the Y+ and Y− direction in the manner set forth above.

The U-shaped section 58 abutting against the inclined surface 34*a* of the latch support base 34 serves as a spring which receives a force when the latch 50 is pushed in the Z−direction. The effective spring length of the latch 50 is made relatively long by the bending of the portion between the fitting section and the arm of the latch 50 by about 180°, i.e., U-shaped section 58 provides a desirable effective spring length for the latch. As a result, a latching operation can be made with a smaller force than a latch which has been used for a conventional electrical connector.

Although one embodiment of the present invention has been explained above, the present invention is not restricted thereto and various changes and modifications can be made within the spirit and scope of the present invention.

For example, the daughter board 2 may take on a vertical, horizontal, oblique, or any other operational attitude and, according to the operational attitude, it is possible to change or modify the housing.

Further, if the operational attitude of the daughter board 2 is vertical or nearly vertical to the mother board, it is possible to design the housing 10 so that a plurality of daughter boards are mounted thereon. Further, the shapes of the latch fitting base 32, latch support base 34 and latch 50 are not restricted to ones as disclosed in the specification and explained above. These members can be changed or modified without departing from the spirit and scope of the present invention.

What is claimed is:

1. An electrical connector for connecting a first circuit board to a second circuit board, comprising:

an electrically insulating housing having a plurality of contact terminals arranged in a mutually parallel relation to electrically connect the first circuit board to the second circuit board;

a pair of elastic spring metal latches connected to opposite ends of the housing, each latch having:

a first end section for latchably securing the second circuit board at a predetermined attitude within the housing;

an intermediate section being substantially transverse in relation to the first end section;

a long arm section extending from the intermediate section in an opposed relation to the first end section, the long arm section extending in a direction corresponding to the attitude of the second circuit board;

a second end section for attachment to the housing;

said housing further having a restricting member disposed between the first end section and the long arm section of each latch, wherein the first end section abuts the restricting member for restricting further displacement of the first end section after the first end section has been displaced a first distance in a direction toward the restricting member, said housing further having a wall restricting surface disposed opposite said restricting member with said first end section being disposed between the restricting member and the wall restricting surface, wherein the first end section abuts the wall restricting surface for restricting further displacement of the first end section after the first end section has been displaced a second distance in direction toward the wall restricting surface.

2. An electrical connector for connecting a first circuit board to a second circuit board, comprising:

an electrically insulating housing having a plurality of contact terminals arranged in a mutually parallel relation to electrically connect the first circuit board to the second circuit board;

a pair of elastic spring metal latches connected to opposite ends of the housing, each latch having:

a first end section for latchably securing the second circuit board at a predetermined attitude within the housing;

an intermediate section being substantially transverse in relation to the first end section;

a long arm section extending from the intermediate section in an opposed relation to the first end section, the long arm section extending in a direction corresponding to the attitude of the second circuit board;

a second end section for attachment to the housing;

said housing further having a restricting member disposed between the first end section and the long arm section of each latch, wherein the first end section abuts the restricting member for restricting further displacement of the first end section after the first end section has been displaced a first distance in a direction toward the restricting member, said restricting member comprising a column member and a projection extending substantially perpendicular from the column member, the column member being integrally connected to the housing and disposed between the first end section and the long arm section of each latch.

3. An electrical connector for connecting a first circuit board to a second circuit board, comprising;

an electrically insulating housing having a plurality of contact terminals arranged in a mutually parallel relation to electrically connect the first circuit board to the second circuit board, said hosing further having first and second latch restricting surfaces;

an elastic spring latch having an elastic section extending substantially parallel to an edge of the second circuit board and a latching section for securing the second circuit board within the housing, a portion of the latching section disposed between the first and second latch restricting surfaces, wherein said portion abuts either the first or second latch restricting surface after the latching section has been displaced a predetermined distance in a direction toward the first or second latch restricting surface to prevent further displacement of the latching section, said housing having an L-shaped restricting member comprising a column member and a projection extending substantially transverse from the column member, the column member being integrally connected to the housing and disposed between the elastic section and the latching section of the latch, wherein said first latch restricting surface forms a surface of said column member.

* * * * *